United States Patent [19]

Radwill

[11] 4,336,758

[45] Jun. 29, 1982

[54] RAILROAD CAR SILL-ARTICULATING DEVICE MEMBER CONNECTION

[75] Inventor: Robert P. Radwill, Chicago, Ill.

[73] Assignee: AMSTED Industries Incorporated, Chicago, Ill.

[21] Appl. No.: 159,213

[22] Filed: Jun. 13, 1980

[51] Int. Cl.[3] ..... B61D 15/00; B61F 3/12

[52] U.S. Cl. ..... 105/4 R; 105/420; 213/75 R

[58] Field of Search ..... 105/3, 4 R, 4 A, 413, 105/414, 420, 421; 213/67 R, 69, 75 R

[56] References Cited

U.S. PATENT DOCUMENTS

| | | | |
|---|---|---|---|
| 2,261,383 | 11/1941 | Johnson et al. | 105/414 X |
| 3,396,673 | 8/1968 | Livelsberger et al. | 105/4 R |
| 3,561,370 | 2/1971 | Reynolds | 105/420 |
| 3,687,084 | 8/1972 | O'Leary et al. | 105/4 R |
| 3,985,235 | 10/1976 | Buzza | 105/420 X |

*Primary Examiner*—Randolph A. Reese

*Attorney, Agent, or Firm*—Fred P. Kostka; Edward J. Brosius; Tony T. Shu

[57] ABSTRACT

Ends of two adjacent railroad cars may be joined by an articulating device when a series of such cars comprises a semi-permanent unit. The articulating device includes a male member which is connected to a sill of the first car and a female member connected to a like sill of the second car. Each connecting member has an inner end portion disposed within the respective sill. The structure of the inner end portion allows it to be joined to the sill by a select pattern of welds. These welds join the connecting member to the sill to form a connection therebetween which may withstand the high static and dynamic forces transmitted from the railroad cars to the articulating device during travel of the unit.

7 Claims, 7 Drawing Figures

RAILROAD CAR SILL-ARTICULATING DEVICE MEMBER CONNECTION

BACKGROUND OF THE INVENTION

1. Field of the Invention

This invention relates to articulated devices for joining railroad cars into semi-permanent units and more particularly to a connection between a sill of the railroad car and a member of the articulating device.

2. Description of the Prior Art

Use of standard AAR (Association of American Railroads) couplers to join railroad cars is well known. Such couplers are so designed to facilitate the connecting or disconnecting of individual railroad cars to allow such cars to be assembled into a train and uncoupled for remote loading or unloading. The Type-E and Type-F couplers are in common use today.

In recent times, the railroad industry has found that joining several cars into a semi-permanent unit is advantageous. For example, railroad cars particularly adapted for piggyback service may be so joined. In this arrangement, an articulating device comprises a male member connected to a sill of one car body and a female member connected to a sill of an adjacent car body. The two members are then joined. The articulating device may in turn be carried by a single railroad car truck.

Articulating devices are disclosed in U.S. Pat. Nos. 3,216,370; 3,396,673; 3,646,604 and 3,716,146, for example. A most recent improvement in articulating devices is disclosed in co-pending U.S. patent application Ser. No. 047,272 which has now matured into U.S. Pat. No. 4,258,628. In all cases these improvements to articulating devices as disclosed therein have been directed to structure providing improved joinder of the members. No attempt has been made to improve the connection between the respective member and the railroad car body sill. The articulating member-railroad car body sill connection as known heretofore could be subject to failure in operation.

SUMMARY OF THE INVENTION

An articulating device for joining railroad cars into a semi-permanent unit includes a male and a female connecting member. These two members may be selectively assembled by a removable pin. An inner end of each member in turn is connected to a sill, which extends outwardly from an end of each railroad car body to be so joined.

The configuration of the sill may vary but in all cases has an open end into which an inner end portion of each connecting member may be placed. By providing an offset in a top wall and sidewalls of the connecting member inner end portion to form stops, the inner end of the connecting member may be accurately located within the sill. Outer surfaces of the sidewalls of each connecting member fit closely against inner surfaces of side members of the sill. End surfaces of the connecting member sidewalls are upwardly and outwardly sloped so that the inner end top wall is shorter than a corresponding bottom wall of each connecting member.

Because the sill typically also has an open bottom, an end surface of the top wall and the sloped end surfaces of the sidewalls of the connecting members may be conveniently joined to the adjacent inner surfaces of the sill members by a series of internal welds. The connection between the sill and the connecting member inner end portion may be further secured by the addition of a plate located under the connecting member bottom wall and between the sill side members. An end surface of the connecting member bottom wall may then be welded to the plate while side surfaces of the plate are welded to the side members of the sill. Additionally, outer edges of the sill may be joined to the stops of the connecting member top and sidewalls by a series of external welds.

This railroad car sill-articulating device member connection provides several advantages over the connection presently known.

These internal welds between the end surfaces of the connecting member walls and the inner surfaces of the sill members and the plate has a rectangular configuration and defines an inclined plane which intersects a vertical axis of the articulating device at a point above the device. This inclined plane also intersects a longitudinal axis of the sill and the articulating device at an acute angle. These welds form a pattern which produces a connection which performs effectively under high static and dynamic forces occurring during travel of the unit.

The welds between the end surface of the connecting member bottom wall and the plate and between the side surfaces of the plate and the side member of the sill define a second plane which is horizontal. The inclined plane and the second horizontal plane intersect at the weld between the plate and the end surface of the connecting member bottom wall. Together the two planes of welds have a wedge-shaped configuration which proves highly resistant to vertical bending forces on the connection. The connection between the connecting member and the sill is still further enhanced by the series of external welds.

DESCRIPTION OF THE PREFERRED EMBODIMENT

Figure 1:
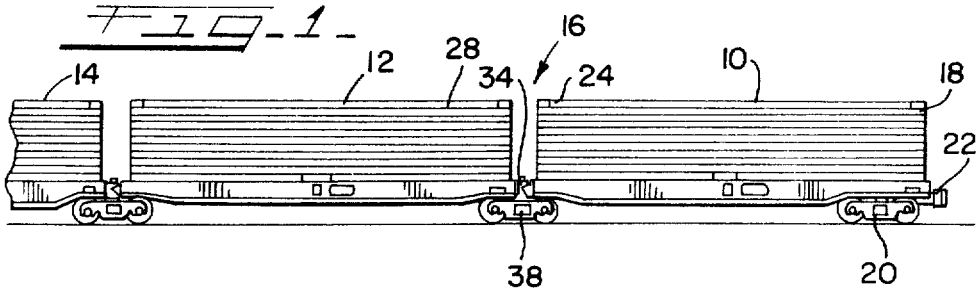
FIG. 1 is a partial side elevational view of a unit of railroad car bodies linked by articulating devices. The devices in turn are joined to a body of the railroad cars by the connection of this invention.

As best understood by viewing FIG. 1, a series of railroad car bodies 10, 12, 14 are joined into a semi-permanent unit 16 shown in part. It should be understood that the unit 16 would typically comprise two or more such car bodies. The car 10 is the first or forwardmost car in the unit 16. A front end 18 of the car 10 is carried in a conventional manner by a railroad car truck 20 and is provided with a standard type coupler 22.

Figure 2:
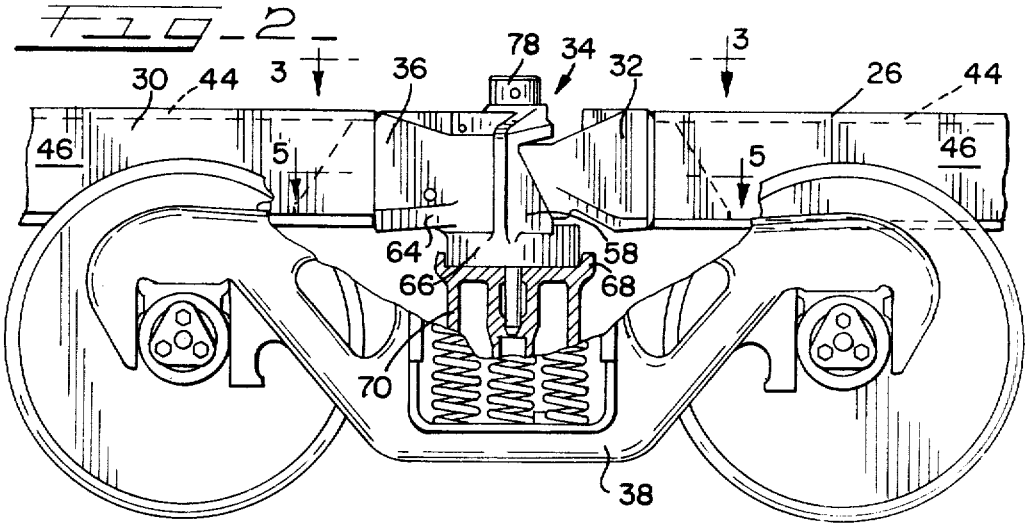
FIG. 2 is a partial side elevational view showing one such articulating device in detail.
Figure 3:
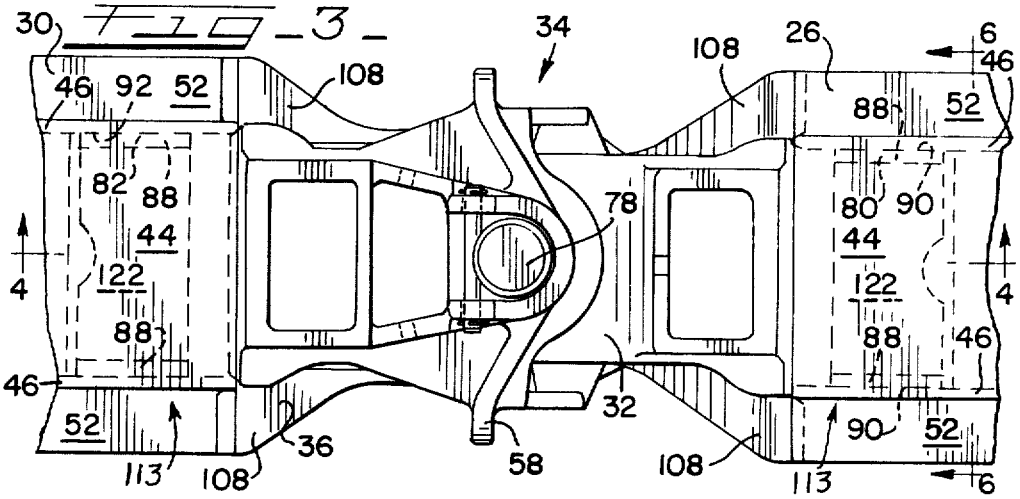
FIG. 3 is a partial plan view of the articulating device as seen generally along the line 3—3 of FIG. 2.

Projecting outwardly from a rear end 24 of the first car body 10 is a sill 26 of a conventional configuration. In a like manner, projecting outwardly from a front end 28 of the car body 12 is a sill 30. Joined to the sill 26 is a male member 32 of an articulating device 34 while a female member 36 of the device 34 is joined to the sill 30 of the car body 12. As shown in some detail in FIG. 2, the articulating device 34 is carried by a further railroad car truck 38. The railroad car bodies 12 and 14 are joined in a similar manner and therefore need not be further described.

Typically a sill, for example the sill 26, has an inverted box-like cross-sectional configuration comprising an upper member 44 joined by spaced vertical side members 46 and an open bottom 48. Projecting outwardly from along a bottom edge 50 of each sill side member 46 are horizontal flanges 52. The sill 26 may be formed without such flanges 52, however. It should be understood that the sill 30 attached to the second car body 12 may be identical to the sill 26, and therefore, like reference numbers are used to identify like structural elements.

Figure 4:
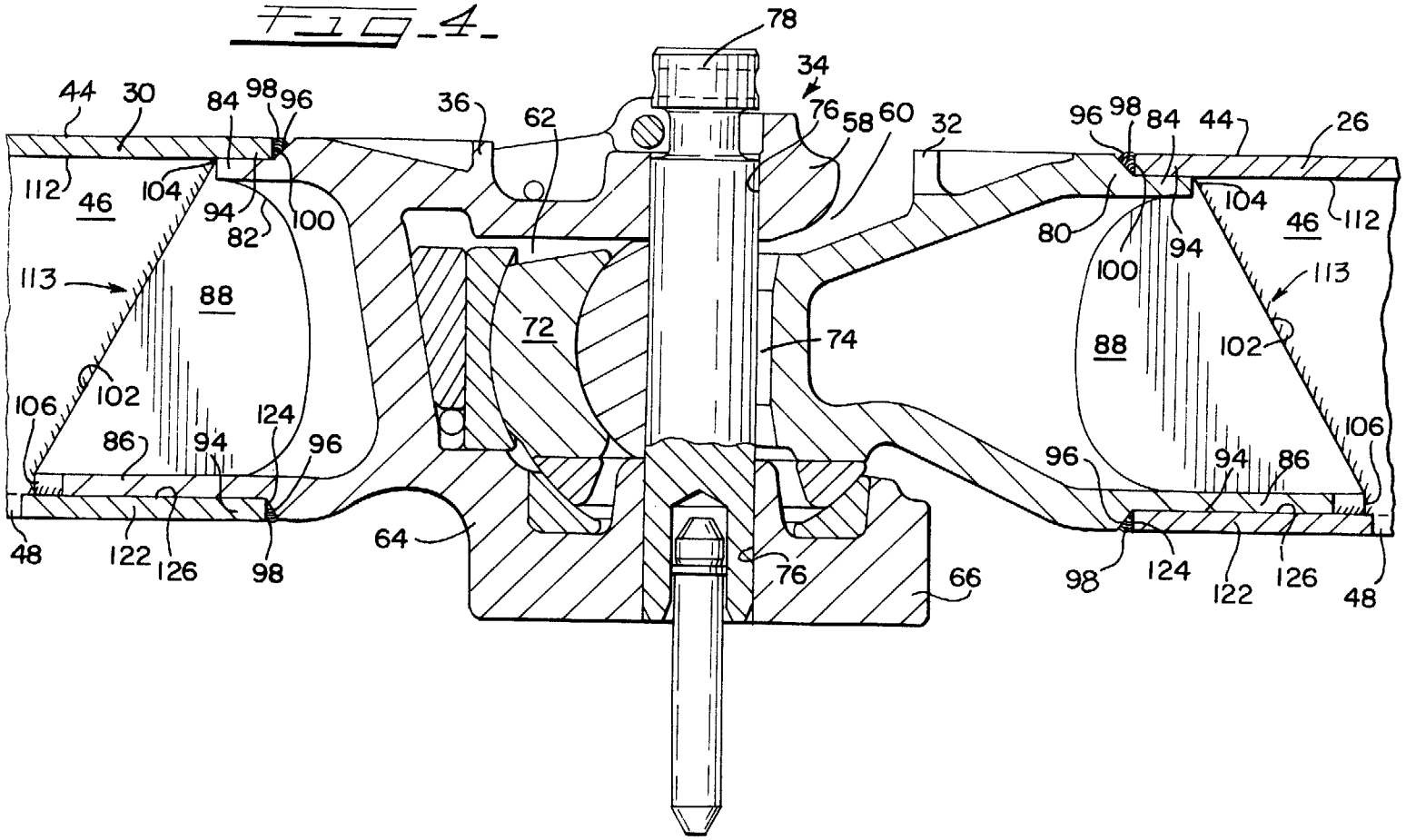
FIG. 4 is a side cross-sectional view of the articulating device as seen generally along the line 4—4 of FIG. 3.
Figure 5:
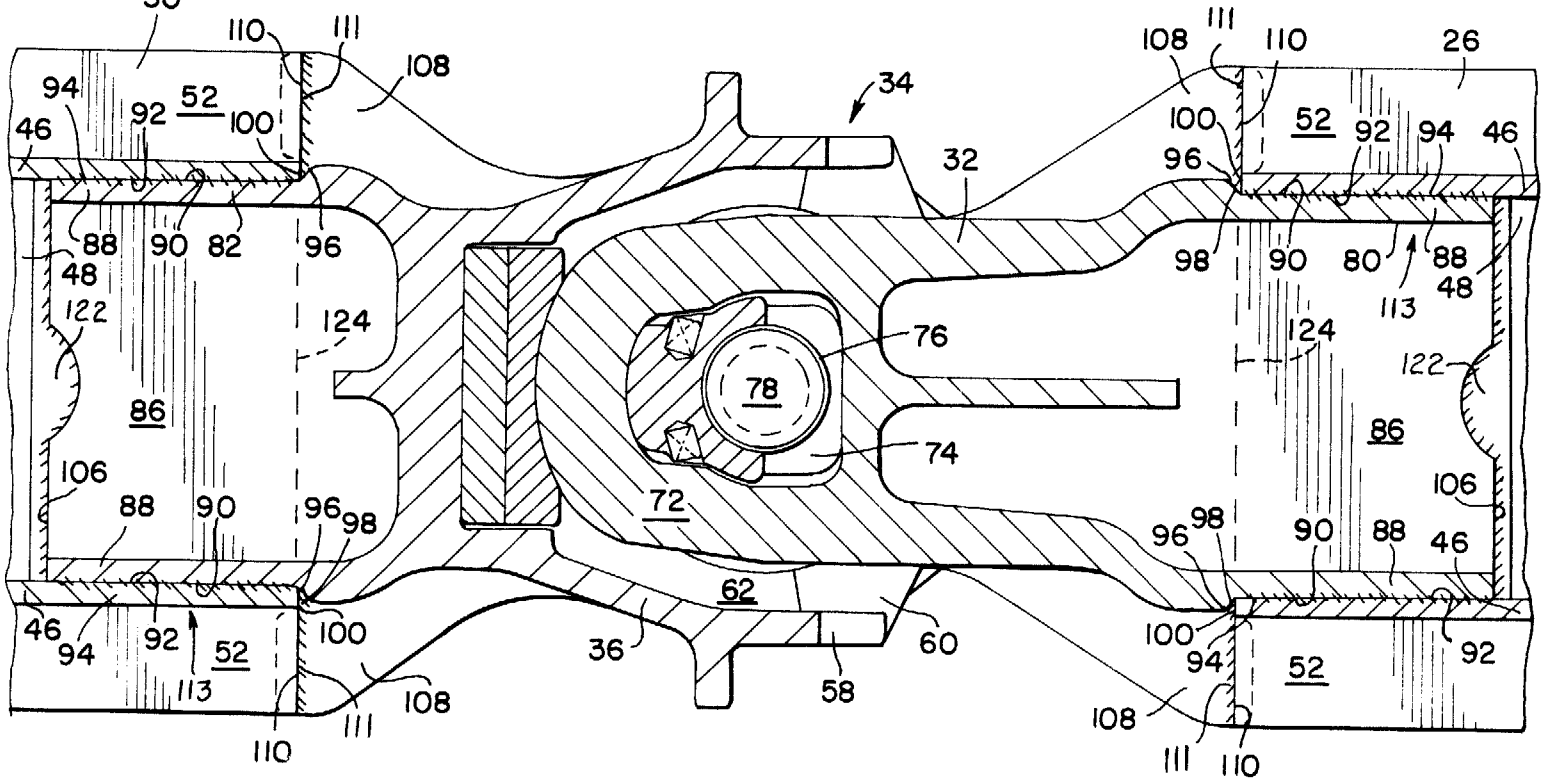
FIG. 5 is a plan cross-sectional view of the articulating device as seen generally along the line 5—5 of FIG. 2.
Figure 6:
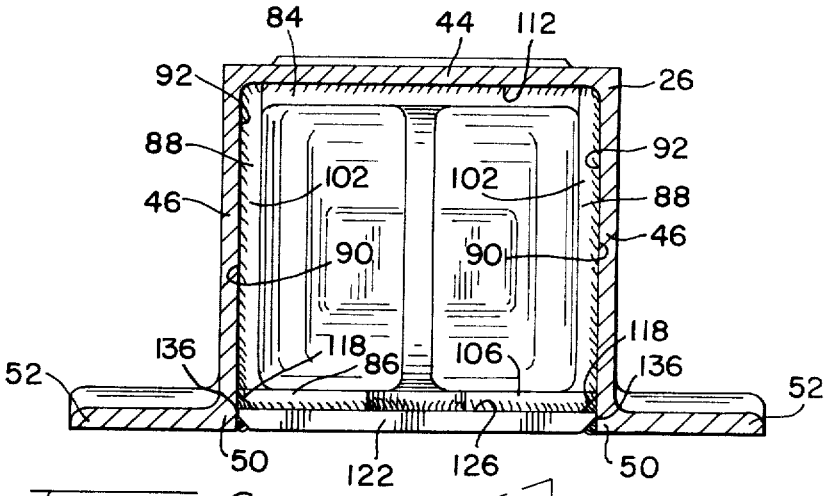
FIG. 6 is an end cross-sectional view of the articulating device as seen generally along the line 6—6 of FIG. 3.

The articulating device 34 is shown in considerable detail in FIGS. 4, 5. An outer portion 58 of the female connecting member 36 is formed with an opening 60 leading to an inner cavity 62. On a bottom side 64 of the female connecting member 36 is a circular boss 66 which fits within a centerplate 68 formed as part of a bolster 70 of the car truck 38.

In an outer end 72 of the male connecting member 32 is a vertical passage 74. The outer end 58 of the female connecting members 36 contains a pair of aligned apertures 76. With the outer end 72 of the male connecting member 32 inserted within the inner cavity 62 of the female connecting member 36, the two connecting members 32, 36 may be joined by a pin 78 inserted through the passage 74 and the apertures 76.

Inner ends 80, 82 of the male and female connecting members 32, 36 are similarly constructed, and therefore, like reference numbers are used to identify like structural elements.

An inner end, for example the inner end 80, of the male connecting member 32 has a hollow rectangular cross-sectional configuration. The inner end 80 is defined by a top wall 84 and a bottom wall 86 carried between spaced sidewalls 88. The sidewalls 88 are so positioned that an outer surface 90 of each fits snugly against an inner surface 92 of each side member 46 of the sills 26, 30. The top wall 84, bottom wall 86 and sidewalls 88 are each formed with an offset portion 94 which terminates at peripherally aligned stops 96. The stops 96 may be formed on an acute angle to provide a respective space 98 between the stops 96 and a respective outer edge 100 of the sill upper and side members 44, 46.

The connecting member top wall 84 has a dimension less than that of the connecting member bottom wall 86 so that end surfaces 102 of the sidewalls 88 are upwardly and outwardly sloped at an angle proximating 60 degrees. Thus, an end surface 104 of the connecting member top wall 84 is longitudinally offset from an end surface 106 of the bottom wall 86.

If the sills 26, 30 include the flanges 52, the male and female connecting members 32, 36 may include flared ribs 108 having end surfaces 110 to abut outer edges 111 of the flanges 52.

A connection 113 between the member inner end portions 80, 82 and the sills 26, 30 is formed as follows. Because of the open bottom 48 of each sill 26, 30, the connecting member top wall end surface 104 may be conveniently joined to an inner surface 112 of the sill upper member 44 by an upper internal weld seam 114. In a like manner, the connecting member sidewall end surfaces 102 may be joined to the inner surface 92 of each sill side member 46 by sloped internal side weld seams 116. Additionally, the connecting member sidewalls 88 may be joined along a bottom edge 118 to the sill side members 46 by lower internal side weld seams 120.

With this welding complete as noted, a plate 122 may be positioned in the connecting member bottom wall offset 94 so that an outer edge 124 of the plate 122 abuts the connecting member bottom wall stop 96 to form a further space 98 therebetween. With the plate 122 so located, the end surface 106 of each connecting member bottom wall 86 may be joined to an upper surface 126 of the plate 122 by a lower internal weld seam 128. These internal weld seams 114, 116, 120 and 128 form a pattern shown by the solid lines in FIG. 7.

Some such sills (not shown) do not have an open bottom such as the open bottom 48 but have a full bottom member. If this were the case, the plate 122 could be omitted. If a plate were used, it could be made full width so as to extend beneath the sill flange 52 as well. Where the sill includes a bottom member, an access opening in the bottom member is provided to allow the internal welding noted.

The connection 113 between the connecting members 32, 36 and respective sills 26, 30 may also include a series of external welds. For example, the outer edge 100 of the sill upper member 44 may be joined to the connecting member top wall 84 by a top external weld seam 130 formed in the top space 98 at the top stop 96. Outer edges 100 of the sill side member 46 may be joined to the connecting member sidewalls 88 by external side weld seams 132 formed in the side spaces 98 at the side stops 96. Next, the outer edge 124 of the plate 122 may be joined to the connecting member bottom wall 86 by an external bottom weld seam 134 placed in the bottom space 98 at the bottom stop 96. Side edges 136 of the plate 122 then may be joined to the side member inner surface 92 along the bottom edges 50 by external bottom side weld seams 138. Lastly, the outer edges 111 of the sill flanges 52 may be joined to the end surfaces 110 of the connecting member flared ribs 108 by lateral weld seams 140.

Figure 7:
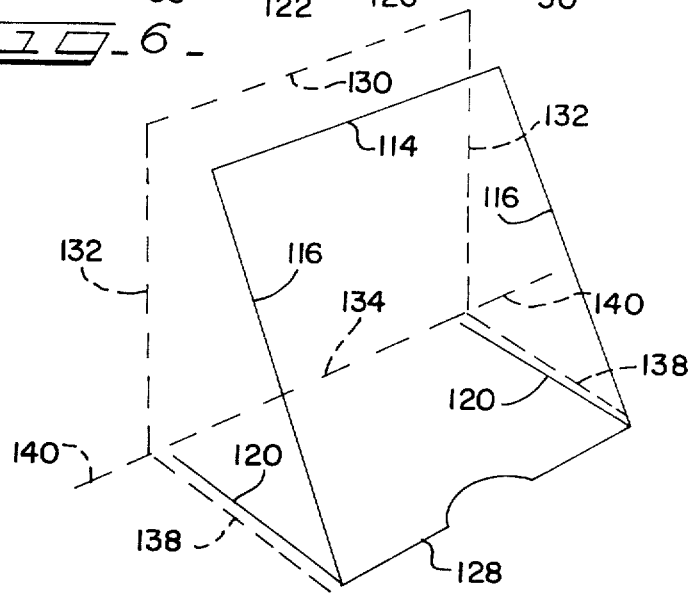
FIG. 7 is a diagram of a preferred internal and external welding pattern used to join a member of the articulating device to a sill of the railroad car.

These external weld seams 130, 132, 134, 138 and 140 form a pattern shown in FIG. 7 by the broken lines. These internal and external weld seam patterns, as they join the related structural elements of the sills 26, 30 and the connecting members 32, 36, insure the structural integrity of the connection 113.

Each connection 113 must endure severe stresses. These stresses are created by impact, shear, tension, compression and bending loads which are transmitted between the sills 26, 30, the articulating device 34 and the truck 38. The loads include a static portion and dynamic portion. The static portion is from the dead weight related to ends 24, 28 of each car body 10, 12. The dynamic portion occurs during operation of the unit 16 wherein the connection 113 transmits draft and buffing forces between the car bodies 10, 12. Additionally, each connection 113 is twisted by out-of-phase rolling movements of the car bodies 10, 12 and the truck 38 and yawing movements when the unit 16 travels about a curved track section or when truck hunting occurs.

While various modifications may be suggested by those versed in the art, it should be understood that I wish to embody within the scope of the patent warranted hereon all such modifications as reasonably and properly come within the scope of my contribution to the art.

What is claimed is:

1. In an articulating device comprising a male connecting member joined to a rear sill of a forward railroad car body of a unit and a female connecting member joined to a front sill of a rearward railroad car body of said unit, said sills each having a box-like configuration defined by an upper member joined to spaced side members with an open bottom and end, said connecting members joinable by a pin and said device supportable on a railroad car truck located below said device, an improvement in a connection between each connecting member and sill comprising, an inner end portion of said connecting member formed with a hollow body defined by a top wall and a bottom wall joined together by spaced sidewalls, said sidewalls having sloped end surfaces joining an end surface of said top wall at a point longitudinally offset from a joinder of said sidewall end surfaces with an end surface of said bottom wall, said connecting member inner end sidewalls spaced to fit snugly against an inner surface of said sill side members with said connecting member inner end top wall and said sidewalls joinable to said sill by a series of internal weld seams to produce said connecting member-sill connection, wherein said connection may withstand high forces imposed by static and dynamic loads transmitted between said car bodies and said truck during operation of said unit.

2. An articulating member-sill connection as defined by claim 1 and further characterized by, said connecting member bottom wall provided with an offset portion terminating at a stop, a plate disposed between said sill side members and in said connecting member bottom wall offset, said plate having an outer edge positioned adjacent to said stop and joinable to said connecting member by a bottom external weld seam disposed in a space formed between said plate outer edge and said stop, by a lower internal weld seam connecting said end surface of connecting member bottom wall and a top surface of said plate, and by external bottom welds connecting side edges of said plate to said sill side member along a respective bottom edge thereof.

3. An articulating member-sill connection as defined by claim 1 and further characterized by said internal welds comprising, an upper internal weld seam joining said end surface of said connecting member top wall to an inner surface of said sill upper member, and sloped internal side weld seams joining said connecting member sidewalls end surfaces to said inner surfaces of said sill side members.

4. An articulating member-sill connection as defined by claim 3 and further characterized by said internal welds further including, lower internal side weld seams joining a bottom edge of said connecting member sidewalls to said inner surface of said sill side members.

5. An articulating member-sill connection as defined by claim 3 and further characterized by, said connecting member top wall provided with an offset portion terminating at a top stop, an outer edge of said sill upper member positioned adjacent to said top stop and joinable to said connecting member by an external top weld seam disposed in a space formed between said sill upper member outer edge and said top stop, and said connecting member sidewalls each provided with an offset portion terminating at a side stop, outer edges of each said sill side member positioned adjacent to said side stop and joinable to said connecting member by external side weld seams disposed in a space formed between said sill side member outer edges and said stops respectively.

6. In a connection between a respective male and female member of an articulating device and a first and second railroad car body, the improvement in said connection comprising, a first sill attached to a rear end of said first railroad car body and a second sill attached to a front end of said second car body, each said sill having box-like cross-sectional configuration defined by an upper member carried between spaced side members and an open end, said male and female connecting members each having an inner end portion defined by vertical sidewalls joined by a top and a bottom wall, said sidewalls having sloped end surfaces with an end surface of said top wall being longitudinally offset from an end surface of said bottom wall, said inner end portion of said male connecting member and said inner end portion of said female connecting member disposed snugly within said first and said second sills respectively and joined together by a pattern of internal and external welds to form said connection, said pattern of internal welds including an upper internal weld seam joining said end surface of said connecting member top wall to an inner surface of said sill upper member and sloped internal side weld seams joining said sloped end surfaces of said connecting member sidewalls to an inner surface of said sill side members, wherein said connection between said sills and articulating device connecting members endures high loading forces transmitted between said car bodies and said truck.

7. In an articulating device for joining two railroad car bodies, said device including a pair of members each having an inner end portion attachable one each to a sill carried by each said car body, said inner end portion of said member comprising a top wall and a bottom wall joined together by spaced side walls, said bottom wall having an end surface substantially spacable from outer edges of said sill upon said member inner end portion being inserted into said sill, and each said inner end portion side wall thereon having a bottom edge and a sloped end surface located to be readily joinable to an inner surface of spaced side members of said sill, said sill having plate means positioned below said articulating device member inner end portion with said end surface of said inner end portion bottom wall located to be readily joinable to said plate means.

* * * * *